United States Patent [19]

Ozawa

[11] Patent Number: 4,925,058

[45] Date of Patent: May 15, 1990

[54] CUP DISPENSER

[75] Inventor: Isao Ozawa, Tokyo, Japan

[73] Assignee: Mizuno Sangyo Co., Ltd., Tokyo, Japan

[21] Appl. No.: 261,902

[22] Filed: Oct. 25, 1988

[30] Foreign Application Priority Data

Jul. 7, 1988 [JP] Japan ..... 63-167824
Jul. 7, 1988 [JP] Japan ..... 63-167825

[51] Int. Cl.[5] ..... B65H 1/08

[52] U.S. Cl. ..... 221/279; 221/307; 221/308; 264/148; 428/174

[58] Field of Search ..... 221/34, 59, 56, 63, 221/64, 65, 221, 307, 308, 309, 310, 279, 265, 305, 280; 411/544, 545; 264/148; 428/174

[56] References Cited

U.S. PATENT DOCUMENTS 1,207,092 12/1916 Sullivan .
1,808,284 6/1931 Bergmann ..... 221/307
2,468,497 4/1949 Johnson et al. .
2,543,746 3/1951 Morrison ..... 221/307
3,108,714 10/1963 O'Brien .
3,191,805 6/1965 Stanley ..... 221/305
3,211,329 10/1965 Boyd .
3,232,480 2/1966 Stanley ..... 221/305
3,942,237 3/1976 Ongaro ..... 264/148
4,295,718 1/1967 Graham, Jr. .
4,372,465 2/1983 Alcorn ..... 221/310

FOREIGN PATENT DOCUMENTS 59-11087 5/1984 Japan .

*Primary Examiner*—H. Grant Skaggs

[57] ABSTRACT

The cup dispenser is disposed of an opening or openings 1*b* formed on one side face of the casing 1 of the dispenser and a receiving container 4 attached to each opening 1*b* provided with a cup pusher 41 connected to a coil spring 42. The opening 1*b* is attached with a delivery opening 3 which incorporates a membrane or membranes 32 each having a circular opening 32*a*. The set of cups 7 received in the receiving container 4 can be pulled out one by one through the delivery opening 3.

5 Claims, 5 Drawing Sheets

CUP DISPENSER

BACKGROUND OF THE INVENTION

The present invention relates to a cup dispenser and to a membrane for use in such a cup dispenser, and more particularly to such cup dispenser from which each of the cups contained therein can be pulled out one by one.

Many fast food shops such as hamburger shops use dispensable cups fabricated of paper or styrofoam, and these dispensable cups are received in a cup dispenser so that each cup may be pulled out one by one.

Such a type of cup dispenser is disclosed in Japanese JITSUYO-SHIN-AN-KOHO (Publication of Examined Utility Model Application for Opposition) SHOWA 59(1984)-11087 (Hereinafter referred to as JIKKOSHO 59-11087) proposed by the inventor of the present invention.

The cup dispenser disclosed by the JIKKOSHO 59-11087 is of the type which comprises a circular outer cylinder in which a coil spring attached with a cup pusher is disposed, an adaptor for delivering cups attached on the flange provided on the top of the outer cylinder, and these two members are covered with a lid so as to form an integrally formed unit.

The adaptor described in the JIKKOSHO 59-11087 is formed as a sub-assembly by stacking a plurality of thin annular frame rings and resilient ring membranes alternately one by one, and then fixing them by set screws into an integral member.

It is required for installing the cup dispenser disclosed in JIKKOSHO 59-11087 to drill a hole or holes on the wall or the counter table, relying on which the cup dispenser is fixed. Consequently, it takes considerable length of time and work, in addition, there arises another problem that the place suitable for placing the cup dispenser is apt to be limited, for instance, it is usually difficult to fixedly place such cup dispenser or the like on a counter.

A first object of the present invention is to provide a cup dispenser which can be readily installed and yet at the place freely selected or changed depending on the condition of the shop.

It is usual, in a fast food shop, to use many cups of larger sizes in summer season for selling cold drinks and smaller ones for serving hot drinks in winter.

Accordingly, it is required for these shops to have a cup dispenser or dispensers capable of receiving cups having different sizes depending on the season.

In order to receive cups of different sizes in a cup dispenser, each of the membranes received in the adaptor of the cup dispenser must have circular opening having a diameter of enough size suitable for the cups of various sizes to be used. Since the adaptor membrane has resiliency, it can be used without replacing if the circular opening of the membrane is slightly larger than the diameter of the cup, but in case where the diameter of the cup is considerably larger than that of the opening, the cup may be deformed or the opening of the membrane damaged, if one tries to forcibly pull out the cup for use.

Consequently, it is usually required to use a membrane having a central opening of suitable size, in order for which use needs disassembling the adaptor for replacing the membrane under use, or alternatively replace the entire adaptor with another one having been provided with suitable membrane(s).

However, there has been the problem of troublesome work in the aforesaid replacement of either the membranes only or the entire adaptor member, since it is necessary to remove the lid and then disassemble the cup dispenser and assemble the cup dispenser again. In addition, the adaptor membrane of the type fabricated of a silicone rubber sheet by die blanking using a die of doughnut like shape, is liable to form a cracks even from minor scratches formed during the die punching, which gives rise to a poor durability, lower resiliency and further a restricted adaptability to the range of the diameter of the cups to be received.

A second object of the present invention is to provide a membrane for a cup dispenser having sufficient resiliency and wider adaptability to the range of the diameter of the cups as well as being unsusceptible to the formation of crack or cracks and having superior durability.

SUMMARY OF THE INVENTION

The cup dispenser of the present invention is constructed in such a manner that one side face of the casing is formed to have an opening or openings into each of which a container provided with a cup pusher is received and also is attached a delivery opening incorporating a membrane having a circular opening to cover the opening.

A cup dispenser of such construction can be disposed merely placing it at any desired place of the shop without making any particular work such as drilling hole or holes.

In addition, it can be freely disposed at any place as long as it allows placing of such cup dispenser, and further by virtue of such feature, it could be ready used and enhances service efficiency of the shop, particularly when this cup dispenser is placed on the top of the counter used as a serving line.

A plurality of projections and fixing pieces are disposed on the outer rim of the opening, in which the projections play two roles, one for preventing expulsion of the cups and the other for fixing the delivery opening, while the fixing pieces are used for fixing the containers receiving therein cups.

Since a cup dispenser equipped with projections on the outer rim of the opening has no fear of causing any expulsion of the contained cups, it can be readily subjected to routine maintenance work.

Moreover, the delivery opening can be made as such one as comprising an adaptor incorporating a membrane or membranes having a circular opening and a lid as an integral member.

The delivery opening having integrally formed adaptor and lid can be assembled in a more simple manner and assures ready handling.

The membrane to be incorporated in the adaptor has a circular opening at its central portion, toward which a corrugated portion is radially formed.

In making the corrugated membrane mentioned above, injection moulding technique is used relying on a ring shaped mould for forming the radially directed corrugation.

By virtue of the corrugated portion, elasticity of the membrane can be improved due to the fact that the portion can be widened in diameter when a cup is pulled out, thereby the adaptability to the diameters of different cups can be improved.

And by virtue of the improved adaptability, the amount of work for replacing the delivery opening can be reduced and it saves the work for such replacement.

Alternatively, a hollow cylindrical silicone rubber pillar extruded under compressed state can be used after it has been sliced into a number of sheets.

For making such a membrane, a silicone rubber bar of hollow cylindrical pillar shape having been extruded under pressure can be used after having been sliced into sheets.

Since the membrane of the cup dispenser fabricated of sliced sheets of silicone rubber bar, has a previously formed opening, they are less liable to form a crack or cracks even if there are formed scratches, thereby it is possible to increase the elasticity of the membrane.

Accordingly, the cup dispenser can be used with less replacement work.

DESCRIPTION OF THE PREFERRED EMBODIMENTS

Explanation will be made in detail on a preferred embodiment of the present invention by referring to the accompanying drawings.

Figure 1:
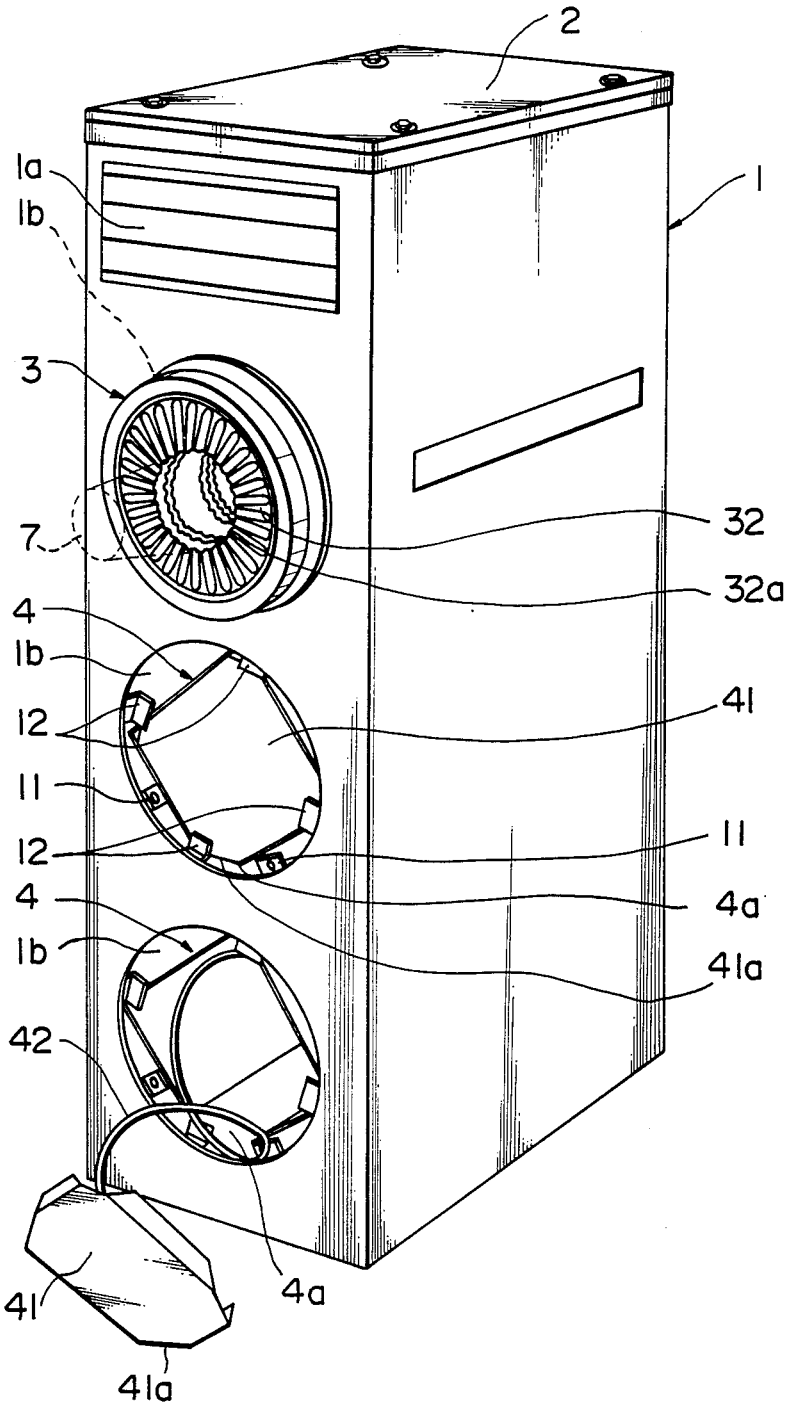
FIG. 1 is a perspective view showing a cup dispenser according to the present invention, wherein the delivery opening attached to the middle and lower region of the dispenser are shown having been removed to facilitate explanation of the invention, in addition, the cup pusher is shown as having been pulled out from the opening at the lower region.

In FIG. 1, the cup dispenser is shown, for the purpose of clear explanation, with its openings in different states, that is, the top opening 1*b* being attached with a delivery opening 3, the middle opening 1*b* with its cup pusher 41 being held by a projection 12 so that it will never be expelled outside the casing 1, and the opening 1*b* at the bottom with the cup pusher 41 having been pulled out through the opening 1*b*.

Numeral 1 in FIG. 1 denotes a casing fabricated of a steel sheet or plastics and a name plate 1*a* for indicating the trade name, symbol and the like is placed on the upper part of the front face of the side wall of the casing.

Numeral 2 donotes a lid attached on the top of the casing 1, made of acryl sheet and the like, which covers the portion for storing (not shown) straws and cup lids or the like.

In FIG. 1, numeral 3 is a delivery opening disposed on the front face of the side wall of the casing 1 for the purpose of pulling out the cup 7 (shown by dot line). Though it is shown that the adaptor and a cover are integrally formed, it can be made by uniting separately formed parts.

Figure 2:
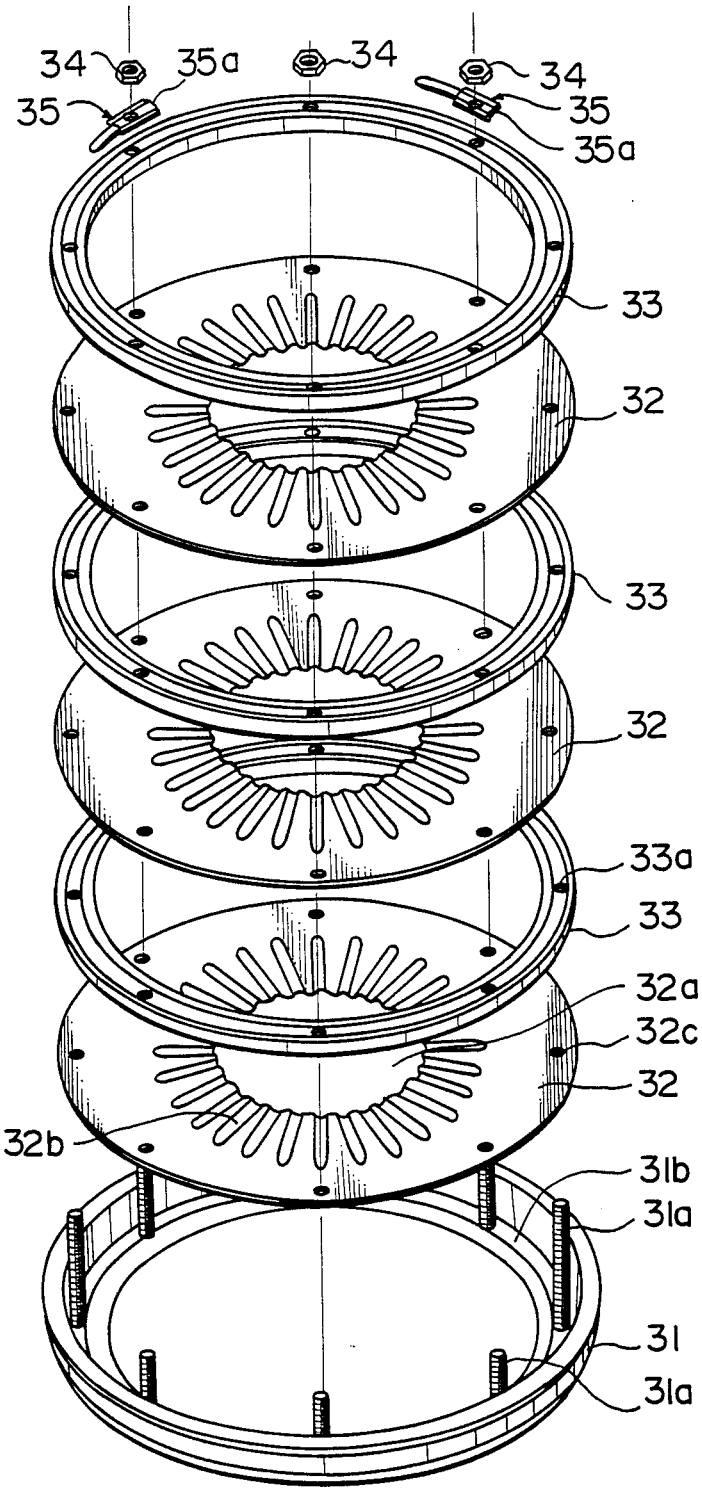
FIG. 2 is an exploded perspective view seen from the rear side of the delivery opening, wherein some of nuts and fixing pieces have been omitted.

The delivery opening 3 as shown by FIG. 2, consists of a short cylindrical cover ring 31 having an annular flange 31*b* on which bolt stems 31*a* are installed, a plurality of membranes 32 and thin annular frame rings 33, both of them assembled to the cover ring 31.

Figure 3:
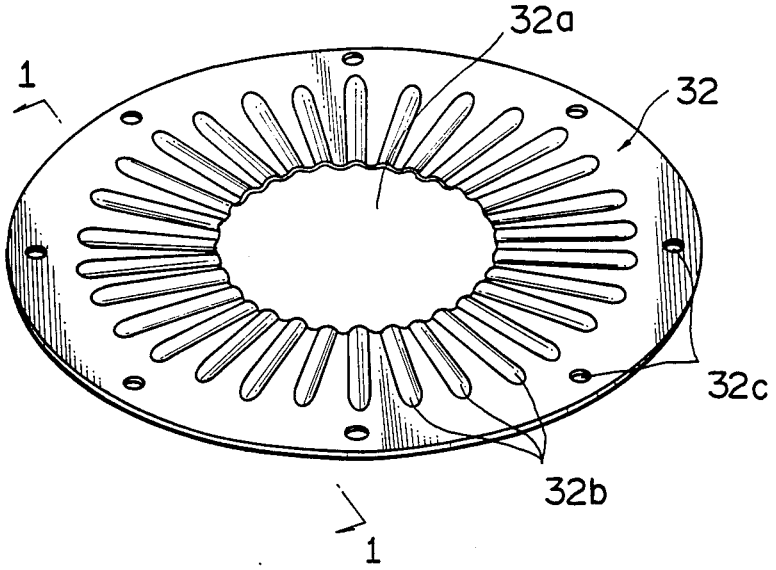
FIG. 3 is a perspective view of a membrane for use in a cup dispenser of the present invention showing the state where corrugations have already been formed.

The membrane 32 is fabricated of an elastomeric material such as silicone rubber and formed at its center, as shown in FIG. 3, with a circular opening 32*a* having a diameter somewhat smaller than the maximam diameter of the cup to be used. The membrane 32 is also formed with corrugated portion 32*b* directed radially to the central opening 32*a* and a plurality of drilled holes 32*c* formed along the periphery of the membrane 32 and at the portion corresponding to the position of the bolt stems 31*a*.

Figure 4:
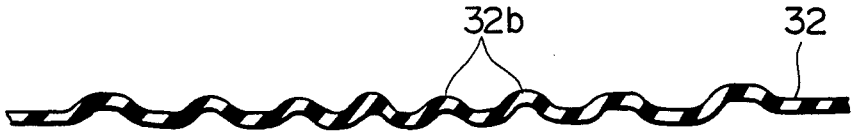
FIG. 4 is a sectional view taken along line 1—1 of FIG. 3, wherein the both ends have been partially cut away.

The corrugated portion 32*b* is formed in such a manner that the distance or space between its adjacent raised portions seen from the front side becomes narrower as they approach toward the circular opening 32*a* at the center and the section of the corrugated portion takes the form of a wavelike configuration as shown in FIG. 4.

Such membrane formed with corrugated portion can be manufactured by injection moulding technique using resilient material such as silicone rubber and using a ringed mould formed with corrugated portion.

The ring frames 33 are used to clamp the membrane 32 between the mating faces defined by the two adjacent ring frames 33 with each other, and they are also formed with perforations 33*a* the portions corresponding to those of the bolt stems 31*a*.

The upper and lower face of the ring frame 33 has an annular groove or protrusion, say one face is formed with an annular groove the other face is formed with an annular protrusion engageable with the annular groove of the next ring frame when assembled, thereby the membrane 32 can be further secured for clamping.

Figure 5:
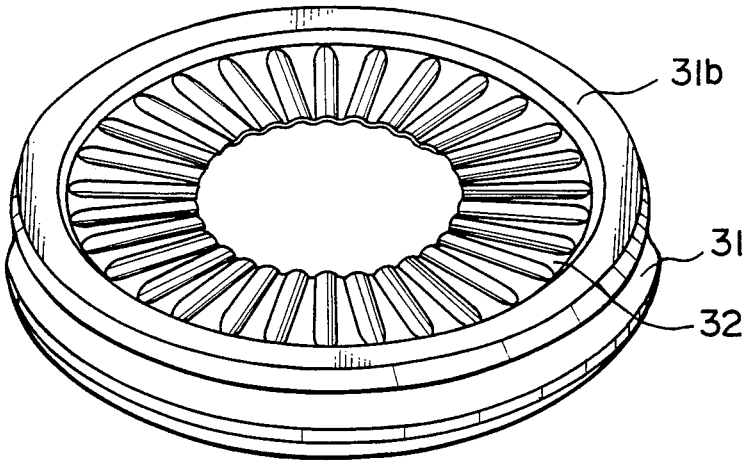
FIG. 5 is a perspective view of a delivery opening incorporating a sheet of membrane seen from the front side.
Figure 6:
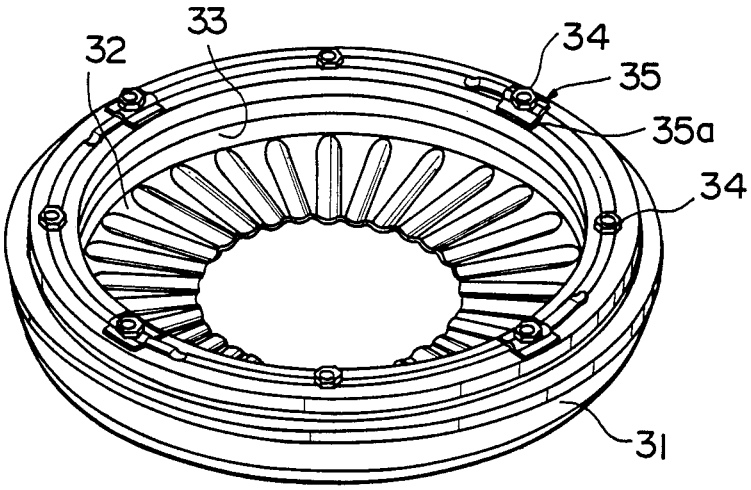
FIG. 6 is a perspective view of a delivery opening incorporating a sheet of membrane seen from the rear side.

The number of the membranes 32 and the ring frames 33 as explained above is not required to be three to constitute three layers as shown in FIG. 2, but any other number, for instance, a single layered deliver opening, as shown in FIG. 5 and 6 can practically used.

The delivery opening 3 can be assembled, as shown in FIG. 2, by correctly positioning the bolt stems 31*a* of the cover ring 31, perforations 32*c* of the membranes 32 and holes 33*a* of the ring frames 33, stacking the membrane 32 and the ring frame 33 alternately one after another and then tightening the nut 34 around each bolt stem 31*a*.

In the drawings, numeral 35 denotes a fixing piece used together with the nut 34 for securing the assembly and is formed with an annular groove 35*a* to receive the protrusion of the ring frame 33.

The casing 1 explained as a preferred form of this invention has openings 1*b* in three layers, that is, at the top, middle and the bottom one, on its front face of the side wall.

Around the periphery of each opening 1*b*, are provided with fixing members 11 for fixing a receiving container 4 and projecting pieces 12 for preventing the cup pusher 41 from being expelled and both members being directed inward.

The receiving container 4 is attached to the fixing members 11 of the opening 1*b* by means of set screws and the like.

The receiving container 4 is formed as a right prism of lengthy boxlike shape with its one corner 4*a* having been cut open and is placed at the bottom, the opposite corner 4*b* is placed at the top and the remaining two corners at right and left.

Disposed within the receiving container 4 is a cup pusher 41 connected to a resilient member such as a coil spring 42.

The cup pusher 41 is a platelike member having a shape similar to the cross section of the receiving container 4 with its four corners being cut away, particularly, the corner 41*a* to be mated with the cut open corner 4*a* of the receiving container 4 is cut away by a larger extent than other corners.

Next explanation will be given on the way of using this cup dispenser.

At first, delivery openings 3 assembled with a membrane 32 having a circular opening 32*a* suitable for the cups to be used are attached to the openings 1*b* of the casing 1, respectively.

This action of attaching is done by aligning the position of the fixing pieces 35 at the side of the delivery opening 3 with the projections 12 at the opening 1*b* of the casing 1, then the delivery opening 3 is fitted into the opening 1*b* and then turned so that the fixing pieces 35 can be engageable with the respective projections 12. In fixing the delivery opening 3, since the cup pusher 41 is prevented from expulsion by the aid of the projecting pieces 12, it is not necessary to depress the cup pusher 41 against the spring force.

After having finished mounting the delivery opening 3 the inversely stacked cups are laid horizontal and pushed inward through the circular opening 32*a* of the membrane 32, then the set of cups can be contained within the cup dispenser against the resilient force imparted by the membrane 32 and the coil spring 42.

Under this condition, the bottom of the cup 7 on the side nearest to the inlet projects outward, and the portion of the cup having largest diameter is clamped either by the circular opening 32*a* alone or a plurality of circular openings 32*a* assembled in a receiving container 4.

In pulling out the cup 7 thus set in the cup dispenser as explained above, it is only necessary to grasp the portion of the cup 7 being projected by ones hand and pull it toward his side, then the circular opening 32*a* of the membrane 32 is widened by the largest diameter portion of the cup 7, thereby the projecting cup 7 can be pulled out from the cup dispenser.

The circular opening 32*a* of the membrane 32 formed with corrugation portion 32*b* would be largely widened by virtue of the corrugation portion 32*b*.

The cups stored behind the projecting cup pulled out still remain inside the receiving container 4 being urged outward by the coil spring 42 and the cup pusher 41, thereby the bottom of the foremost cup in the set is projected through the circular opening 32*a* of the membrane 32.

According to this preferred embodiment, since the size of the circular opening 32*a* of the resilient membrane 32 is set, to some extent smaller than the largest diameter portion of the cup, the cup and membrane 32 closely contact with each other with no clearance.

In this embodiment, the cup pusher 41 is urged by the coil spring 42 toward the user's side, but due to the existence of the cut-open corner 4*a*, the receiving container 4 of square cross section and the cup pusher 41 contact with each other at the lower sides of the cup pusher 41, and thus the pushing action can be carried out in a very stable manner.

When it is necessary to remove the delivery opening 3 to check the sales of the day or the like, it has only to turn the delivery opening 3 in reverse direction, thus the delivery opening 3 can be readily removed from the casing 1 by a single action.

Upon removal of the delivery opening 3, the remaining cups in the set are pushed by the cup pusher 41 toward the side of the user.

At this moment, the cup pusher 41 is prevented from its repulsion outside the receiving container 4 by means of the projecting pieces 12.

Interior of the receiving container 4 can be cleaned by removing the delivery opening 3 out of the casing 1, and because of the fact that there are hardly any protruded or indented portions inside the receiving container 4 of the cup dispenser of the present invention, the cleaning can be done in a very easy manner, thereby it is possible to keep hygienic conditions which are particularly important in the field of fast food industries.

Figure 7:
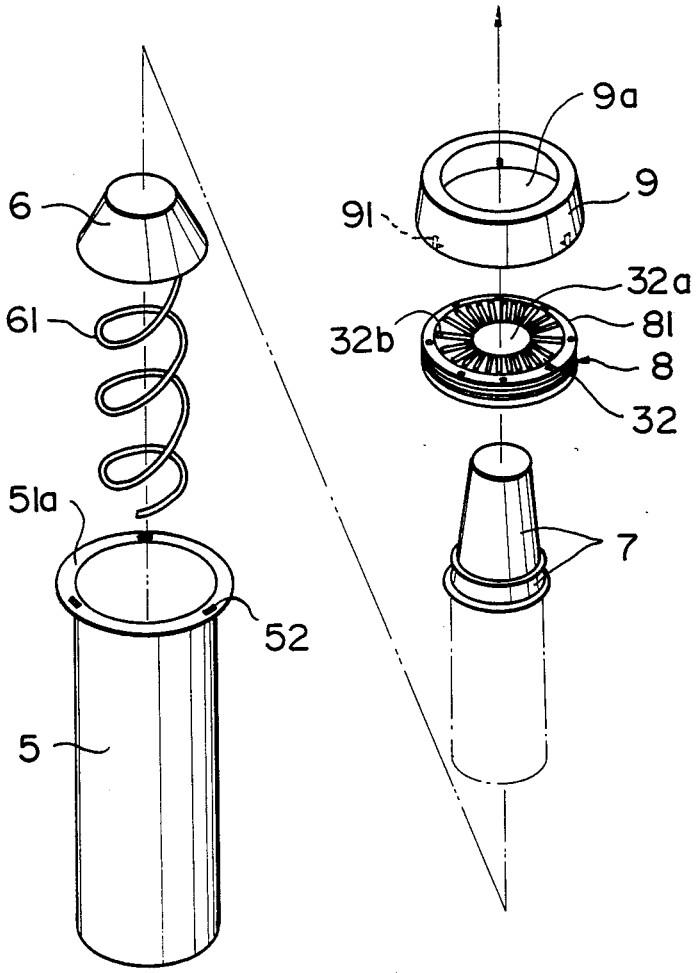
FIG. 7 is a perspective view of a conventional type cup dispenser, however comprising an adaptor incorporating a membrane formed with corrugations according to the present invention.

Above-mentioned membrane 32 with corrugated portion 32*b* also can be used as a membrane to be incorporate in an adaptor of the conventional type cup dispenser as shown in FIG. 7.

Explanation will now be made here on the construction of the conventional type cup dispenser.

Numeral 5 in FIG. 7 denotes an outer cylinder of a long hollow cylinder made of metal or plastics and the outer periphery at the top of the tube is formed with an annular flange 51*a*, the upper face of which is attached with latches 52 along the periphery.

Numeral 6 in the drawing is a cup pusher of truncated cone shape having the size to be loosely fitted inside the outer cylinder 5, and numeral 61 denotes a coil spring inserted in the outer cylinder 5, lower end of which spring 61 seats on the bottom face of the outer cylinder 5, while the upper end is connected to the cup pusher 6.

In the drawing, numeral 8 is an adaptor having a diameter slightly smaller than that of flange 51*a* and is disposed on the upper face of the flange 51*a*.

The adaptor 8 is composed of a plurality of pieces of thin ring frames 81 stacked one on another, between which a membrane 32 of the cup dispenser is clamped in a closely contracted way and is fixed by set screws or the like.

Numeral 9 is a lid of a truncated conical cylinder having a central opening 9*a*, at the inner side of the lower end of which is attached with L-shaped projections 91 to be engaged with said latches 52 projected at the positions corresponding to those of the latches 52.

Next, explanation will be made on a way of using a conventional type cup dispenser disposed with an adaptor 8 incorporating a membrane or membranes 32 formed with corrugations 32*b*.

Firstly, the membrane 32 having a circular central opening 32*a* of desired size is clamped by the frame 81 and then is fixed by set screws to constitute the adaptor 8.

Then, the coil spring 61 connected with the cup pusher 6 is fitted in the outer cylinder 5, onto the flange 51*a* of which outer cylinder 5 the adaptor 8 is mounted and then the lid 9 is placed on the adaptor 8. Next, the L-shaped projections 91 of the lid 9 and the latches 52 on the flange 51*a* are engaged with to constitute an integral assembly of the adaptor 8, lid 9 and the outer cylinder 5.

In order to set a series of cups 7 into the assembled cup dispenser as explained above, it is necessary that the series of inversely stacked ups 7,7, . . . are depressed downward through both the central opening 9*a* of the lid 9 and the circular opening 32*a* of the membrane 32, then these stacked cups 7,7, . . . are contained in the outer cylinder 5 against the resilient forces imparted by the membrane 32 and the coil spring 61.

At this instance, the uppermost cup 7 among the set of cups 7,7, . . . is projected upward passing through the central opening 9*a* of the lid 9 and the circular opening 32*a* of the membrane 32.

Under this condition, the maximum diameter portion of the uppermost cup as mentioned above is clamped either by the central opening 32*a* of the uppermost layer alone or by the plurality of central openings 32*a*,32*a*, . . . and so forth.

If one wishes to pull out the cup 7 set in the cup dispenser, it is only necessary for him to grasp by his hand the portion of the uppermost cup 7 being projected to pull it upward, then the circular central opening 32*a* of the membrane 32 would be widened larger than the mamimum diameter of the cup to allow the cup 7 to be pulled out from the cup dispenser.

Due to the existence of the corrugated portion 32*b*, the circular opening 32*a* could be widened larger than that when such corrugations had not been formed.

The cups 7,7, . . . having been set subsequent to the uppermost cup 7 will remain inside the outer casing 5 for a while, but these cups 7,7, . . . will be urged upward to some extent by the coil spring 61 and the cup pusher 6, thereby the cup 7 set second would project passing through the central opening 9*a* of the lid 9 and the circular opening 32*a* of the membrane 32.

Since the size of the circular opening 32*a* of the membrane 32 having resiliency is rendered slightly smaller than the maximum diameter of the cup 7, the membrane 32 and the cup 7 will engage with each other with completely tight fitting with no clearance therebetween.

Similarly, the upper inner side of the lid 9 also closely contacts the upper face of the adaptor 8, so there is no fear that there should arise any undesirable clearance formed between the adaptor 8 and the lid 9.

In disassembling this cup dispenser, it can be made by the steps following the order reverse to that explained above.

Namely, the lid 9 and the adaptor 8 can be readily removed from the outer cylinder 5, that is, by releasing the L-shaped projection 91 from the latch 52 by means of turning the lid 9 in reverse direction.

By this way of removing the adaptor 8, it is possible to replace the adaptor 8 being used with a new adaptor 8 incorporatiog a circular opening 32*a* of a size suitable for the cups 7 to be used.

It is also possible to use membranes other than those formed with corrugated portion as mentioned above, that is, such membranes, not shown, that formed by forming the sheet which has been made by slicing a hollow cylindrical bar of silicone rubber extruded under pressure.

For making such membranes as mentioned above, silicone rubber can be used as a raw material and a bar hollow cylindrical shape is formed at first by extrusion under pressure and the bar thus formed is sliced into a number of sheets.

The silicone bar mentioned above is formed with a hollow portion for making the central opening and hollow portions near the periphery for screw setting.

The membranes fabricated as mentioned above has improved resiliency resulting in widened adaptability to the range of the diameter of the cups to be used, the adaptor can be replaced with less number of replacement.

Moreover, the membrane of the present invention can withstand more against the formation of cracks initiating from the crack or cracks, thereby it is possible to improve the durability of the cup dispenser as a whole, by relying on the membrane or membranes of the present invention.

What I claim is:

1. A cup dispenser which comprises a casing having at least one opening formed through a side facing of said casing, a plurality of projections on said casing extending inwardly of said opening, a receiving container within said casing for holding a stack of cups for dispensing through said opening, means within said receiving container for urging said stack of cups toward said opening, said means including a plate member secured to one end of a resilient spring member, said spring member having its other end secured to said receiving container, said plate member being of a size to engage said projections when no cups are in said receiving container, an adaptor disposed about the said opening in said casing, said adaptor holding at least one flexible elastomeric membrane over said opening, said membrane having an annular opening therethrough, and means for securing said adaptor and membrane externally of said casing.

2. The cup dispenser as defined in claim 1 wherein said membraine has the circumferential edge of said annular opening of wavelike or corrugated shape formed by a plurality of depressions extending radially outwardly through a substantial portion of the radius of said membrane.

3. The cup dispenser as defined in claim 1 wherein said means for securing said adaptor and membrane externally of said casing comprises a plurality of fastening means engaging said projecting means.

4. The cup dispenser as defined in claim 3 including a cover surrounding the outer circumferential surfaces of said adaptor and membrane, said cover including means for fastening said cover to said receiving container.

5. A flexible elastomeric membrane for use in a cup dispenser, said membrane having an annular opening through which a cup is dispensed, the circumferential edge of said annular opening being of wavelike or corrugated shape formed by a plurality of depressions extending radially outwardly through a substantial portion of the radius of said membrane, whereby said circumferential edge of said membrane is in tight fitting contact with the outer surface of the cup being dispensed through said opening.

* * * * *